US006618019B1

(12) United States Patent
Kenoun

(10) Patent No.: US 6,618,019 B1
(45) Date of Patent: Sep. 9, 2003

(54) STUBBY LOOP ANTENNA WITH COMMON FEED POINT

(75) Inventor: Robert Kenoun, Palatine, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/155,206

(22) Filed: May 24, 2002

(51) Int. Cl.[7] ..... H01Q 21/00

(52) U.S. Cl. ..... 343/725; 343/702; 343/893; 343/728

(58) Field of Search ..... 343/702, 725, 343/726, 728, 895, 893, 850

(56) References Cited

U.S. PATENT DOCUMENTS 5,760,747 A * 6/1998 McCoy et al. ..... 343/728
5,812,097 A * 9/1998 Maldonado ..... 343/790
5,963,170 A * 10/1999 Garner et al. ..... 343/702
6,031,496 A * 2/2000 Kuittinen et al. ..... 343/702
6,154,177 A * 11/2000 Saito et al. ..... 343/702
6,181,286 B1 * 1/2001 Roscoe et al. ..... 343/725
6,229,488 B1 * 5/2001 Lin et al. ..... 343/700 MS
6,448,934 B1 * 9/2002 Lee et al. ..... 343/702
6,501,428 B1 * 12/2002 Blom et al. ..... 343/702
6,538,611 B2 * 3/2003 Noro ..... 343/725

* cited by examiner

*Primary Examiner*—Don Wong
*Assistant Examiner*—Shi-Chao Chen
(74) *Attorney, Agent, or Firm*—Brian M. Mancini

(57) ABSTRACT

An antenna adapted to operate in multiple frequency bands includes a first conductive loop element having a commonly driven electrical connection at both ends. The first conductive element is resonant at a first frequency. An electrical feed point is located at the commonly driven electrical connection of the first conductive element. A second conductive element includes a straight portion and a helical portion. The straight portion being is coupled to the electrical feed point and the helical portion being is located distally from the feed point. The second conductive element being resonant at a second frequency. This commonly driven loop provides for a wider bandwidth and allows for a more compact multi-band antenna.

20 Claims, 2 Drawing Sheets

STUBBY LOOP ANTENNA WITH COMMON FEED POINT

FIELD OF THE INVENTION

The present invention is related to an antenna, and more particularly to an antenna adapted to operate in more than one frequency band.

BACKGROUND OF THE INVENTION

With the increased use of wireless communication devices, available spectrum to carry communication signals is becoming limited. In many cases, network operators providing services on one particular band have had to provide service on a separate band to accommodate its customers. For example, network operators providing service on the Global System of Mobile (GSM) communication system in a 900 MHz frequency band have had to also rely on operating on the Digital Communication System (DCS) at an 1800 MHz frequency band. Accordingly, wireless communication devices, such as cellular radiotelephones, must be able to communicate at both frequencies, or possibly a third frequency spectrum, such as the Personal Communication System (PCS) 1900 MHz or Global Position System (GPS) 1500 MHz.

Such a requirement to operate at two or more frequencies creates a number of problems. For example, the wireless communication device must have an antenna adapted to receive signals on more than one frequency band. Also, as wireless communication devices decrease in size, there is a further need to reduce the size of an antenna associated with the device.

An extendible antenna can be used to advantage to provide multiple frequency operation, but such an antenna poses problems to an end user. Because the antenna will typically perform better when in the extended position, the user is required to extend the antenna before operating the wireless communication device. Users may not regularly do this as the device may usually operate with the antenna in a retracted position, and this action requires extra effort. As a result, many end users prefer a fixed or "stubby" antenna which does not need to be extended during operation. However, the fixed antenna must provide multi-band functionality.

As the need for multi-band operation in radiotelephones increases, a greater demand is placed on the antenna to cover all these frequencies of operation using a small, compact structure. Moreover, antennas need to be efficient with good return loss performance and suitable radiated patterns. Further, antennas are adversely affected by the proximity of a user's hand, which is almost unavoidable with increasingly small telephone sizes.

Accordingly, there is a need for a small fixed antenna adapted to receive signals in multiple frequency bands. In addition, it would be of benefit if the different resonant elements of the antenna can be commonly driven. It would also be advantageous to provide the antenna structure in a compact, fixed structure that is less susceptible to efficiency changes due to the placement of a user's hand on or near the antenna.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENTS

The present invention provides a small fixed antenna adapted to receive signals in multiple frequency bands. This is achieved in a low-cost structure without any degradation in performance over prior art antennas. Two different resonant elements are provided that are commonly driven. One of the elements is a loop antenna, which, as a result of its being commonly driven, has a high impedance point that effectively separates the loop into two elements, effectively increasing operating bandwidth. The present invention also has the benefit of providing an antenna in a compact, fixed structure that is less susceptible to efficiency changes due to the placement of a user's hand on or near the antenna.

The present disclosure is related to an antenna adapted to receive signals in multiple frequency bands. In particular, the antenna includes a loop element and a straight wire element with a helical portion to reduce its length. Preferably, a single matching circuit is adapted to provide matching for both elements. A dielectric material preferably surrounds the elements to provide mechanical support. A single electrical connection is used to couple the elements, including both ends of the loop element, to the wireless communication device although multiple connections can be used. The loop element is used to provide additional bandwidth for the 1800 to 1900 MHz frequency bands.

Figure 1:
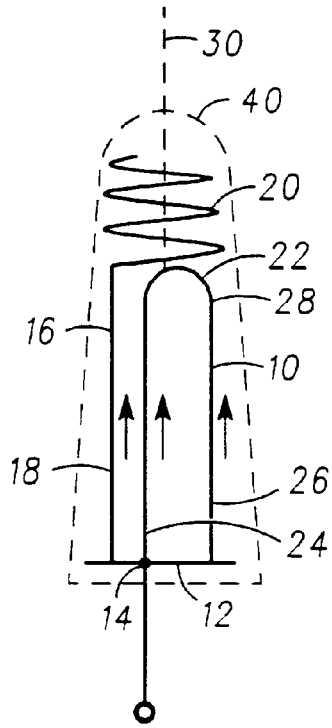
FIG. 1 is a side view of a preferred embodiment of an antenna apparatus, in according with the present invention.

Turning to FIG. 1, a preferred embodiment of an antenna is shown. In its simplest form, the present invention provides an antenna adapted to operate in at least two frequency bands. A first conductive loop element 10 is a U-shaped wire with both ends connected to a commonly driven electrical connection 12 for driving the antenna. The first conductive element 10 is resonant at a first frequency. An electrical feed point 14 is located at the commonly driven electrical connection 12 of the first conductive element 10. In practice, the first conductive loop element 10 consists of two straight wire portions 24,26 both connected to the commonly driven electrical connection 12 at one end and a loop portion 28 connecting the other ends of both straight wire portions 24,26 together.

A second conductive element 16 is also coupled to the electrical feed point 14. The second conductive element 16 is resonant at a second frequency, lower than the first frequency. Typically, the first and second frequencies have substantially non-overlapping bands. The second conductive element 16 has a straight wire portion 18 coupled to the electrical feed point 14 and a helical portion 20. The helical portion is included to reduce the physical length of the second conductive element 16 to make the antenna apparatus more compact. The helical portion 20 is located distally from the feed point 14, above the first conductive loop element 10. In general, the first conductive loop element 10 is located between the electrical feed point 14 and the helical portion 20 of the second conductive element 16 for ease of manufacturability. The straight portion 18 of the second conductive element 16 and the straight portions 24,26 of the first conductive loop element 10 are substantially parallel and are electromagnetically coupled.

Inasmuch as the helical element is most susceptible to changes due to placement of a user's hands, the helical portion 20 is located the farthest distance from the base of the antenna. Is it felt that the probability of a user touching the base of the antenna is a normal way is far greater than probability of placing one's fingers on top of the antenna. The present invention provides an advantage by placing the helical portion distal from the antenna base, and the straight wire portions closer to the base. The straight wire portions of all the elements are less sensitive to a user's hand and resultant shift in frequencies than is the helical coil portion, which does not exist in the lower half of the antenna. It is also desirable to limit the cross-coupling between the helical portion 20 and the other portions of the antenna as this degrades the performance and bandwidth of both structures. This can be accomplished by having the straight wire portions 24,26 of the first conductive loop element 10 being substantially parallel to a central axis 30 of the helical portion 20 of the second conductive element 16.

In operation, the currents flow in the same direction (shown upwards in FIG. 1) in all of the elements. At one point on the top of the first conductive loop element 10 these currents cancel each other and force that point to be a virtual high impedance point 22 where substantially no current flows. This high impedance point effectively breaks the loop in half and makes the loop element behave as two independent segments, each resonating at a frequency proportional to the length of its wire segment. This has been confirmed by experiment wherein the loop was cut at the high impedance (top) point, and the frequency performance compared to the uncut antenna. The frequency performance between the two was substantially the same. The location of the high impedance point is typically on the loop portion 28 of the first conductive loop element 10. Generally, this would be at the half-length point of the loop (i.e. the top of the loop portion), but this can shift slightly due to cross-coupling between the elements 10,16. As a results, the two straight wire portions 24,26 of the first conductive loop element 10 are preferably configured to have a length of less than or equal to one-quarter of a wavelength of the first operating frequency. The nature of the loop element makes the actual length shorter as the width of the loop increases. The loop portion in fact not only improves the bandwidth, it also shortens the required length of the structure if only a wire were used, which helps the compaction of the unit. Each straight wire portion 24,26 will have slightly different frequency responses in the band of interest, thereby increasing bandwidth. Alternatively, the loop can be replaced by a solid plate of the same outside dimension. A plate such as this can affect bandwidth with a change in its effective width (in the plane of the plate).

The antenna structure can also include a protective support and covering 40. For example, helical elements can be wound on a dielectric core (not shown) within an overmold, which comprises a dielectric material. The core could be a dielectric material comprising 75% santoprene and 25% polypropylene to create dielectric material having a dielectric constant of 2.0. In another example, a dielectric sleeve can be used to cover elements with straight wire portions. For example, the dielectric sleeve could be a Teflon™ material. In addition to providing a wider bandwidth, the dielectrics provide mechanical strength to the antenna. As long as proper dielectric constants can be found, solid plastic could also be used. Alternatively, some areas of the antenna could remain empty, whereby air which has a dielectric constant of one, which also provides good electrical characteristics. Further, the helical portion could also be completely surrounded by a dielectric.

Figure 2:
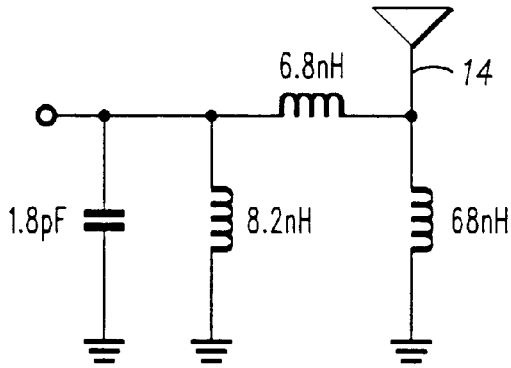
FIG. 2 is a schematic of a matching circuit for the antenna apparatus of FIG. 1.

In practice, the antenna is coupled and matched to the circuitry of a communication device as is known in the art. FIG. 2 shows an example of a matching circuit that can successfully be used with the present invention. Of course, it should be realized that different circuitry can also be used successfully, and depends on the particular application. In addition, there are various other practical considerations to be made, as are known in the art. For example, the length of the straight wire portions generally effects vertical polarization, where a longer straight portion generally provides greater polarization. The length and axial and radial dimensions of the conductive elements are preferably selected to optimize the efficiency of the antenna. That is, the size, length, width and diameter of the elements are selected to provide the proper inductance or capacitance for the antenna, as are known in the art. For example, a narrower element provides greater inductance and wider element provides greater capacitance. In addition, longer elements have lower frequencies.

Figure 3:
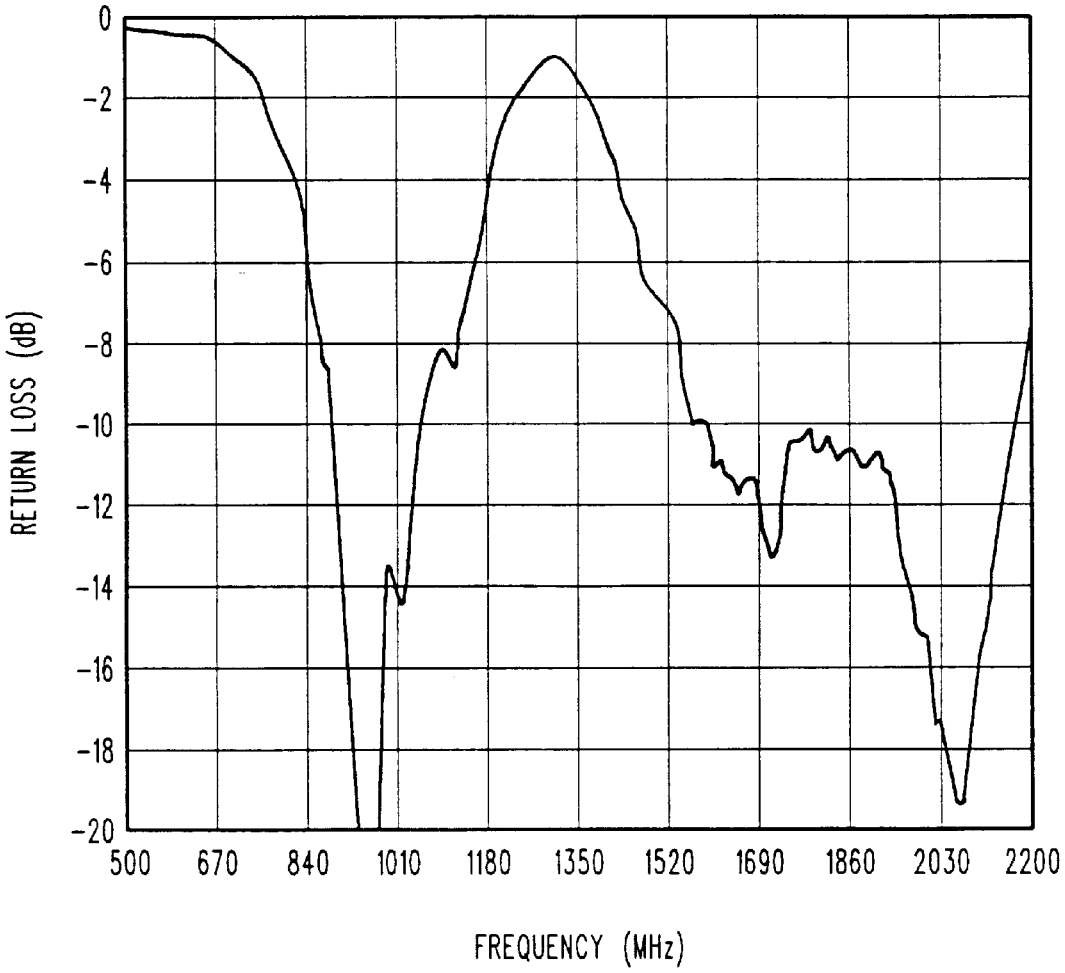
FIG. 3 is a graphical representation of the frequency response of the antenna apparatus of FIG. 1.

Turning now to FIG. 3, a graph shows the operating frequencies of the antenna of FIG. 1 when coupled to the matching circuit of FIG. 2. Return loss is shown as a function of frequency. As can be seen in the figure, the antenna will operate at a dual resonance for signals between 830–960 MHz band for the loop element and 1710–2000 MHz band for the second element, which covers the frequency bands of AMPS, GSM, DCS, PCS, and PHS. With modification of the length of the straight wire and the helical coil, the resonating frequency can be tuned to any frequency band desired including the GPS band. As can be seen a bandwidth of about 170 MHz (at 10 dB return loss) is achieved for the low frequency band, and a bandwidth of about 550 MHz (for 10 dB return loss) is achieved for the high frequency band. The wideband performance of the present invention is a result of the multiple resonant modes of the segments of the elements and how they are coupled. With further improved matching, the antenna can also cover the GPS band.

In summary, the present disclosure is related to an antenna adapted to receive signals in multiple frequency bands. In particular, the antenna includes a loop wire element with both ends commonly driven.

Although the invention has been described and illustrated in the above description and drawings, it is understood that this description is by way of example only and that numerous changes and modifications can me made by those skilled in the art without departing from the broad scope of the invention. Although the present invention finds particular use in portable cellular radiotelephones, the invention could be applied to any two-way wireless communication device, including pagers, electronic organizers, and computers. Applicant's invention should be limited only by the following claims.

What is claimed is:

1. An antenna adapted to operate in multiple frequency bands, the antenna comprising:

a first conductive loop element having a commonly driven electrical connection at both ends thereof, the first conductive element being resonant at a first frequency;

an electrical feed point located at the commonly driven electrical connection of the first conductive element; and a second conductive element having a straight portion and a helical portion, the straight portion being coupled to the electrical feed point and the helical portion being located distally from the feed point, the second conductive element being resonant at a second frequency.

2. The antenna of claim 1, wherein the first conductive loop element has a high impedance point where substantially no current flows.

3. The antenna of claim 1, wherein the first conductive loop element consists of two straight wire portions both connected to the commonly driven electrical connection at one end and a loop portion connecting the other ends of both straight wire portions together.

4. The antenna of claim 3, wherein the first conductive loop element has a high impedance point in the loop portion where substantially no current flows.

5. The antenna of claim 3, wherein the straight portion of the second conductive element and the straight portions of the first conductive loop element are substantially parallel and are electromagnetically coupled.

6. The antenna of claim 3, wherein the first conductive loop element is located between the electrical feed point and the helical portion of the second conductive element.

7. The antenna of claim 3, wherein the two straight wire portions of the first conductive loop element each have a length of less than or equal to one-quarter of a wavelength of the first operating frequency.

8. The antenna of claim 3, wherein the straight wire portions of the first conductive loop element are substantially parallel to a central axis of the helical portion of the second conductive element.

9. An antenna adapted to operate in multiple frequency bands, the antenna comprising:

a first conductive loop element having two straight wire portions both connected to a the commonly driven electrical connection at one end and a loop portion connecting the other ends, the first conductive loop element having a high impedance point where substantially no current flows such that the two portions of the first conductive loop element between the commonly driven electrical connection and the high impedance point are resonant at a first frequency;

an electrical feed point located at the commonly driven electrical connection of the first conductive element; and a second conductive element having a straight portion and a helical portion, the straight portion being coupled to the electrical feed point and the helical portion being located distally from the feed point, the second conductive element being resonant at a second frequency.

10. The antenna of claim 9, wherein the high impedance point of the first conductive loop element is in the loop portion.

11. The antenna of claim 9, wherein the straight portion of the second conductive element and the straight portions of the first conductive loop element are substantially parallel and are electromagnetically coupled.

12. The antenna of claim 9, wherein the first conductive loop element is located between the electrical feed point and the helical portion of the second conductive element.

13. The antenna of claim 12, wherein the straight wire portions of the first conductive loop element are substantially parallel to a central axis of the helical portion of the second conductive element.

14. The antenna of claim 9, wherein the two straight wire portions of the first conductive loop element each have a length of less than or equal to one-quarter of a wavelength of the first operating frequency.

15. An antenna adapted to operate in multiple frequency bands, the antenna comprising:

a first conductive loop element having two straight wire portions both connected to a the commonly driven electrical connection at one end and a loop portion connecting the other ends, the loop portion having a high impedance point where substantially no current flows such that the two portions of the first conductive loop element between the commonly driven electrical connection and the high impedance point are resonant at a first frequency;

an electrical feed point located at the commonly driven electrical connection of the first conductive element; and a second conductive element having a straight portion and a helical portion, the straight portion being coupled to the electrical feed point and the helical portion being located distally from the feed point and above the first conductive loop element, the second conductive element being resonant at a second frequency.

16. The antenna of claim 15, wherein the first and second conductive elements provide electromagnetic coupling therebetween.

17. The antenna of claim 16, wherein the straight portion of the second conductive element and the straight portions of the first conductive loop element are substantially parallel.

18. The antenna of claim 15, wherein the straight wire portions of the first conductive loop element are substantially parallel to a central axis of the helical portion of the second conductive element.

19. The antenna of claim 15, wherein the two straight wire portions of the first conductive loop element each have a length of approximately one-quarter of a wavelength of the first operating frequency.

20. The antenna of claim 15, wherein the first operating frequency is higher than the second operating frequency.

* * * * *